US008632143B2

(12) United States Patent
Jeakings

(10) Patent No.: US 8,632,143 B2
(45) Date of Patent: Jan. 21, 2014

(54) SLIDING SUPPORTS

(75) Inventor: Rodney Jeakings, Northampton (GB)

(73) Assignee: Accuride International Limited (GB)

( * ) Notice: Subject to any disclaimer, the term of this patent is extended or adjusted under 35 U.S.C. 154(b) by 0 days.

(21) Appl. No.: 12/964,336

(22) Filed: Dec. 9, 2010

(65) Prior Publication Data

US 2011/0142380 A1 Jun. 16, 2011

Related U.S. Application Data

(63) Continuation of application No. PCT/GB2009/001476, filed on Jun. 12, 2009.

(30) Foreign Application Priority Data

Jun. 13, 2008 (GB) ..... 0810896.1

(51) Int. Cl.
*A47B 88/04* (2006.01)

(52) U.S. Cl.
USPC ..... 312/334.11; 312/334.1

(58) Field of Classification Search
USPC ..... 312/330.1, 334.1, 334.7, 334.8, 334.11, 312/334.15, 334.16, 334.17, 334.26, 312/334.32, 334.33, 334.37, 334.38; 384/18, 20
See application file for complete search history.

(56) References Cited

U.S. PATENT DOCUMENTS 5,344,228 A * 9/1994 Kovarik et al. ..... 312/334.9
5,472,272 A * 12/1995 Hoffman ..... 312/334.11
6,132,020 A * 10/2000 Schael et al. ..... 312/334.1

FOREIGN PATENT DOCUMENTS

DE 29807536 U1 6/1998
EP 0574164 A 12/1993

OTHER PUBLICATIONS

International Search Report/Written Opinion for PCT/GB2009/001476, dated Sep. 16, 2009, 12 pages.

* cited by examiner

*Primary Examiner* — James O Hansen
(74) *Attorney, Agent, or Firm* — Brian B. Shaw, Esq.; Thomas B. Ryan; Harter Secrest & Emery LLP

(57) ABSTRACT

The present invention relates to sliding supports and particularly sliding supports having two elongate members of channel section and an intermediate member positioned between the elongate members. The invention provides a sliding support with improved manufacturability and load bearing capability by providing an intermediate member of alternative cross-section.

17 Claims, 2 Drawing Sheets

SLIDING SUPPORTS

CROSS-REFERENCE TO RELATED APPLICATIONS

The present application is a continuation of International Patent Application No. PCT/GB2009/001476 filed Jun. 12, 2009, which claims priority to Great Britain Patent Application No. GB0810896.1, filed Jun. 13, 2008. Each of these priority applications is hereby expressly incorporated by reference.

STATEMENT REGARDING FEDERALLY SPONSORED RESEARCH OR DEVELOPMENT

Not applicable.

REFERENCE TO A "SEQUENCE LISTING"

Not applicable.

FIELD OF THE INVENTION

The invention relates to sliding supports.

BACKGROUND OF THE INVENTION

Description of Related Art

It is known to provide sliding supports for use in furniture or domestic appliances, such as ovens and dishwashers. Such sliding supports having two (or more) elongate members, typically of shallow channel section, which slide one within the other, one of the members being secured to a slidable drawer or rack, and the other to a frame in which the drawer or rack is supported. Sliding engagement between the members is typically provided by ball bearings retained by a retaining member located between the two elongate members.

It is also known to provide sliding supports having two elongate channel section members offset relative to one another, and an intermediate member positioned between the two elongate members. Sliding engagement between the members is provided by ball bearings positioned between the elongate members and the intermediate member and retained by retaining members located within the channel section elongate members. Such a sliding support as manufactured by the present applicant, Accuride International Limited, is shown in FIG. 1. The arrangement of FIG. 1 provides a unit which is compact for its strength. However, it is desirable to provide a unit with an increased load bearing capability.

Accordingly, there is a need for an improved compact sliding support which offers increased load bearing capability.

BRIEF SUMMARY OF THE INVENTION

According to the invention, there is provided a sliding support comprising:

a first elongate slide member of channel section defining a first web and first and second flanges, a second elongate slide member of channel section defining a second web and third and fourth flanges, an intermediate member positioned between the first and second slide members, first locating means positioned between the first slide member and the intermediate member to locate and align the first slide member and the intermediate member for sliding without contact therebetween, and second locating means positioned between the second slide member and the intermediate member to locate and align the second slide member and the intermediate member for sliding without contact therebetween, wherein the first and second flanges are offset relative to the third and fourth flanges in a direction parallel to the first and second webs, and the intermediate member has a cross-section comprising a third channel section connected to a fourth channel section by a connecting member arranged at an angle to the first and second webs.

The sliding support of the present invention is a compact unit which, consequently, has a reduced material requirement and is thus a cost-effective design.

By incorporating a connecting member which is arranged at an angle to the first and second webs, some flexing is allowed in the intermediate member. The present inventors found that such flexing increases the load bearing capacity of the support over similarly sized prior art supports. The improved intermediate member also adds stability to the support. This design of member also makes manufacture easier and more consistent than for known prior art.

The sliding support is for supporting any element or body required to be linearly movably mounted relative to another body.

The offsetting of the first and second slide members relative to one another benefits the mounting of the sliding bodies relative to one another.

The cross-section of the intermediate member may be unhanded. Consequently, left-handed and right-handed sliding supports can be manufactured using the same intermediate member and slide members. Consequently, the cost-efficiency of manufacturing the sliding supports is optimised.

The third channel section may define a third web and fifth and sixth flanges, and the fourth channel section may define a fourth web and seventh and eighth flanges, and the fifth flange may be connected to the seventh flange by the connecting member.

The connecting member may comprise a fifth web which connects the fifth and seventh flanges together at their open ends.

The angle between the connecting member and the first and second webs may be in the range of 70 to 80 degrees. Alternatively, the angle between the connecting member and the first and second webs may be in the range of 60 to 85 degrees. Alternatively, the angle between the connecting member and the first and second webs may be in the range of 30 to 85 degrees. The angle may take any value provided that the connecting member is not parallel to the first and second webs.

The first and second locating means may each comprise a multiplicity of ball bearings and a retainer for retaining the ball bearings in two parallel rows, one row on each side of each of the first and second slide members, between the first and second slide members and the intermediate member, to locate slidingly the intermediate member within the first and second slide members.

In particular, a first row of ball bearings may be positioned between the first and sixth flanges, a second row of ball bearings may be positioned between the second and seventh flanges, a third row of ball bearings may be positioned between the third and fifth flanges, and a fourth row of ball bearings may be positioned between the fourth and eighth flanges.

The cross-sectional profile of each of the first to eighth flanges may be shaped to provide half of a ball engaging channel such that the rows of ball bearings are retained between the respective first and second slide members and the intermediate member in a plurality of ball channels. Preferably, the ball bearings are retained in four separate ball channels.

The ball retainer is preferably formed of polymeric material (for example material sold under the registered trade mark Nylon 66).

The shape of the intermediate member is a positive influence on the strength of the sliding support in operation. The amount of distortion (wind out) of the balltracks when the sliding support is tested to destruction is significantly less than expected: the sliding supports are able to withstand more weight than anticipated. Moreover, on cycle testing the amount of permanent deformation is less than expected.

In an alternative configuration, the first and second locating means may each comprise a plastics strip, preferably of self-lubricating plastics material, arranged between the respective slide member and the intermediate member, to locate slidingly the intermediate member within the first and second slide members.

The first and second slide members and the intermediate member may be made of steel, such as mild or stainless steel (or other suitable material).

BRIEF DESCRIPTION OF THE DRAWINGS

By way of example, an embodiment of a sliding support according to the invention will now be described with reference to the accompanying drawings, in which.

DETAILED DESCRIPTION OF THE INVENTION

Figure 1:
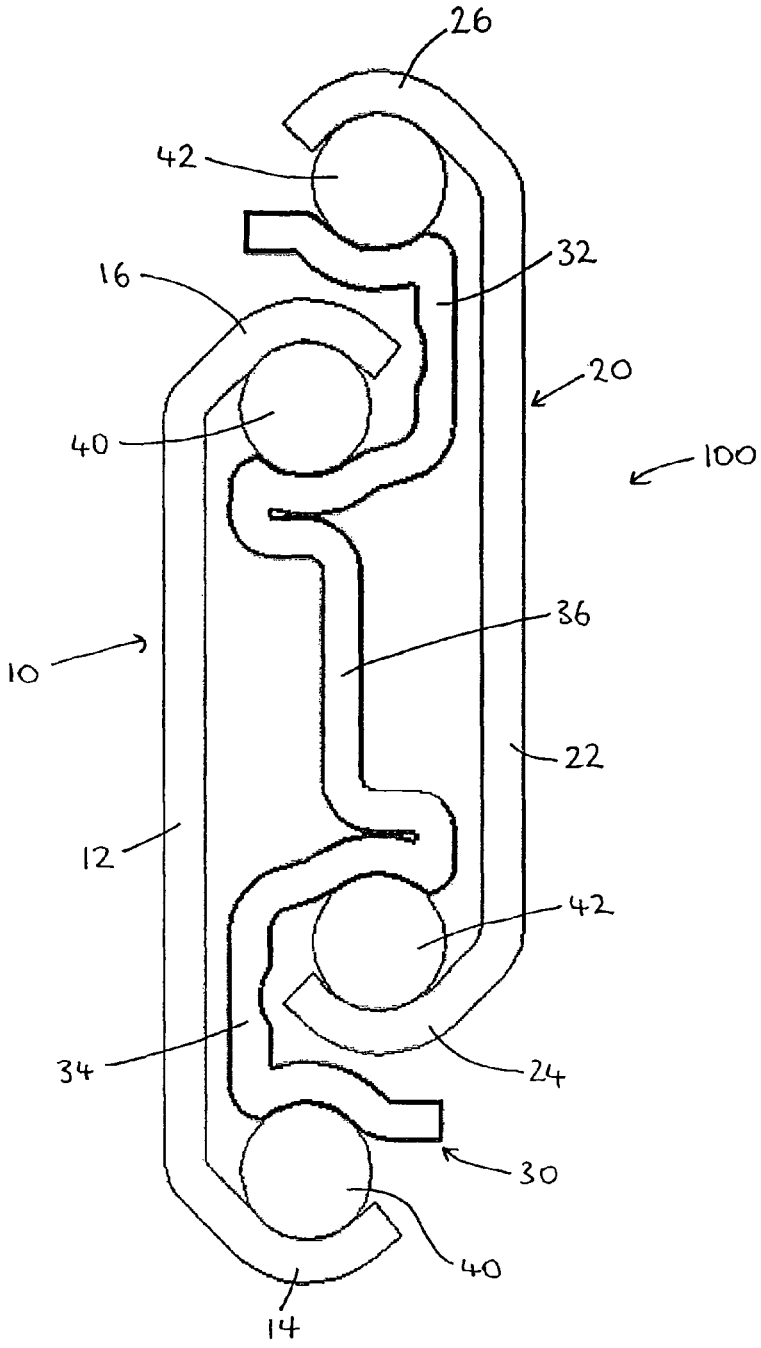
FIGURE 1 (Prior art)
FIG. 1 is a sectional view of a sliding support according to the prior art.

As mentioned above, FIG. 1 shows a sectional view of a prior art sliding support generally indicated at 101.

The prior art sliding support 101 includes a first elongate slide member 10 of channel section defining a first web 12 and first and second flanges 14, 16. The support 100 also includes a second elongate slide member 20 of channel section defining a second web 22 and third and fourth flanges 24, 26. An intermediate member 30 is positioned between the first and second slide members 10, 20. Two parallel rows of ball bearings 40 are positioned between the first slide member 10 and the intermediate member 30 to locate and align the first slide member 10 and the intermediate member 30 for sliding without contact therebetween. Two further parallel rows of ball bearings 42 are positioned between the second slide member 20 and the intermediate member 30 to locate and align the second slide member 20 and the intermediate member 30 for sliding without contact therebetween. The first and second flanges 14, 16 are offset relative to the third and fourth flanges 24, 26 in a direction parallel to the first and second webs 12, 22. The intermediate member 30 has a section comprising a third channel section 32 connected to a fourth channel section 34 by a connecting member 36 arranged parallel to the first and second webs 12, 22.

Figure 2:
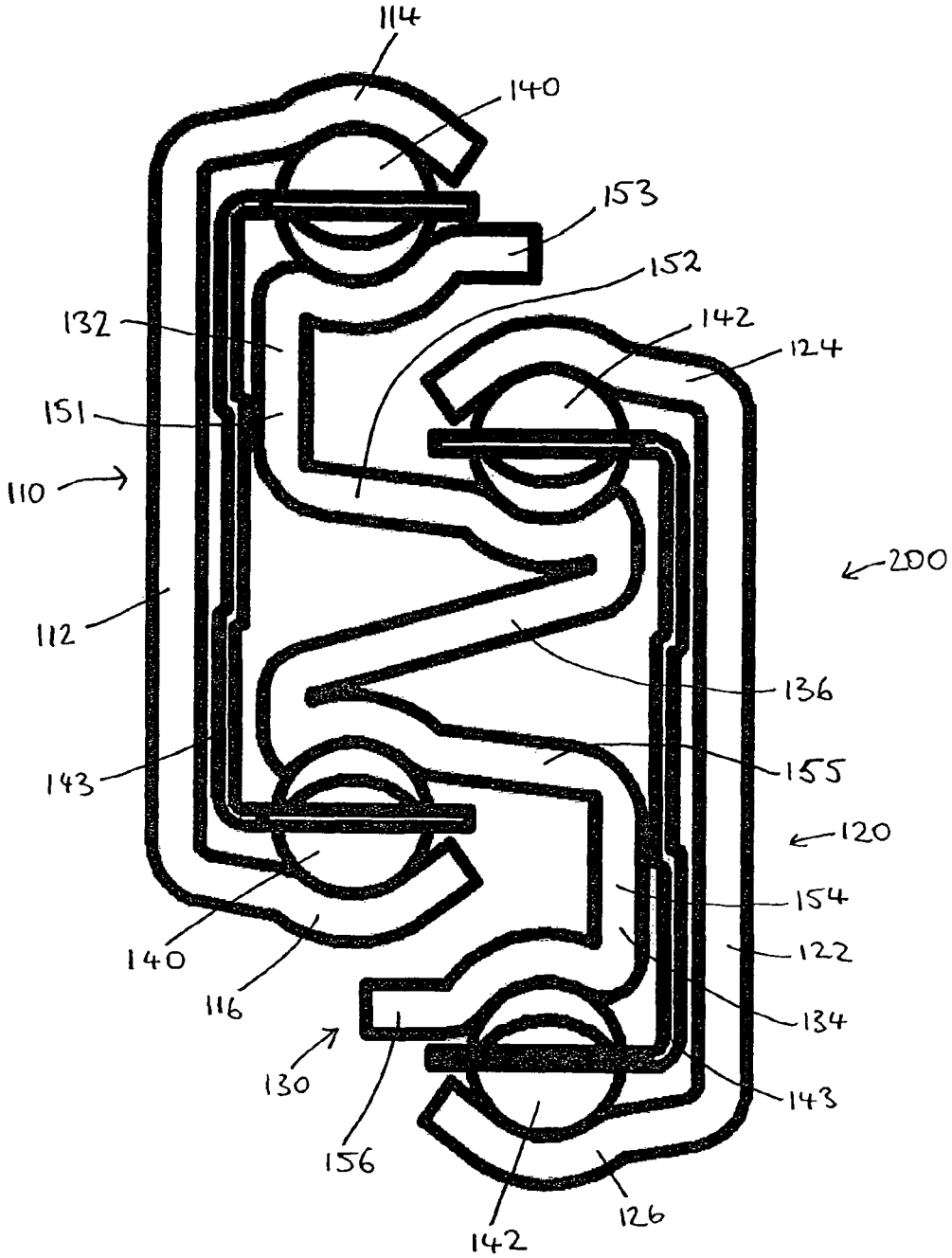
FIG. 2 is a sectional view of a sliding support according to the present invention.

According to an embodiment of the present invention as shown in FIG. 2, there is provided a sliding support 200 comprising a first elongate slide member 110 of channel section defining a first web 112 and first and second flanges 114, 116. The sliding support 200 also includes a second elongate slide member 120 of channel section defining a second web 122 and third and fourth flanges 124, 126. An intermediate member 130 is positioned between the first and second slide members 110, 120. Two parallel rows of ball bearings 140 are positioned between the first slide member 110 and the intermediate member 130 to locate and align the first slide member 110 and the intermediate member 130 for sliding without contact therebetween. Two further parallel rows of ball bearings 142 are positioned between the second slide member 120 and the intermediate member 130 to locate and align the second slide member 120 and the intermediate member 130 for sliding without contact therebetween. The first and second flanges 114, 116 are offset relative to the third and fourth flanges 124, 126 in a direction parallel to the first and second webs 112, 122. The intermediate member 130 has a cross-section comprising a third channel section 132 connected to a fourth channel section 134 by a connecting member preferably a fifth web 136 arranged at an angle to the first and second webs 112, 122.

The third channel section 132 is defined by a third web 151 and fifth and sixth flanges 152, 153 and the fourth channel 134 section is defined by a fourth web 154 and seventh and eighth flanges 155, 156. The fifth flange 152 is connected to the seventh flange 155 by the connecting member 136.

The angle between the connecting member 136 and the first and second webs 112, 122 is in the range of 70 to 80 degrees. However, the angle may take any value provided that the connecting member 136 is not parallel to the first and second webs 112, 122.

Four rows of ball bearings are retained in parallel rows by two retainers 143, one row on each side of each of the first and second slide members 110, 120, between the first and second slide members 110, 120 and the intermediate member 130, to locate slidingly the intermediate member 130 within the first and second slide members 110, 120.

The retainers 143 each have a base, extending parallel to the webs of the first and second slide members 110, 120, and side webs which both carry a series of holes of a size to be engaged by and retain the ball bearings 140, 141.

In particular, a first row of ball bearings 140 is positioned between the first and sixth flanges 114, 153, a second row of ball bearings 140 is positioned between the second and seventh flanges 116, 155, a third row of ball bearings 141 is positioned between the third and fifth flanges 124, 152, and a fourth row of ball bearings 141 is positioned between the fourth and eighth flanges 126, 156.

The cross-sectional profile of each of the first to eighth flanges 114, 116, 124, 126, 152, 153, 154, 155 is curved to provide half of a ball engaging channel such that the rows of ball bearings 140, 141 are retained between the respective first and second slide members 110, 120 and the intermediate member 130 in a plurality of ball channels.

In use, the first slide member 110 is fixedly mounted to a first body (not shown). The second slide member 120 is fixedly mounted to a second body (not shown) in relation to which the first body is to be slidable linearly.

It will be appreciated that the embodiment described in detail has been described by way of example only, and that alterations or modifications may be made within the scope of the invention as defined in the appended claims.

The invention claimed is:

1. A sliding support comprising:

a first elongate slide member having a channel shaped cross section and including first and second flanges and a first web disposed between the flanges, a second elongate slide member having a channel shaped cross section and including third and fourth flanges and a second web parallel to the first web disposed between the third and fourth flanges, the first and second flanges being offset relative to the third and fourth flanges in a direction parallel to the first and second webs, and an intermediate member positioned between the first and second slide members, the intermediate member comprising a first portion having a channel shaped cross section and including fifth and sixth flanges and a third web connected between the fifth and sixth flanges; and a second portion having a channel shaped cross section and including seventh and eighth flanges and a fourth web connected between the seventh and eighth flanges;

a connecting member connected between the fifth and seventh flanges and arranged at an angle to the first and second webs, wherein the angle between the connecting member and the first and second webs is in the range of 30 to 85 degrees, first locating means positioned between the first slide member and the intermediate member to locate and align the first slide member and the intermediate member for sliding without contact therebetween, and second locating means positioned between the second slide member and the intermediate member to locate and align the second slide member and the intermediate member for sliding without contact therebetween, wherein the first locating means comprises:

a first row of ball bearings positioned between the first and sixth flanges, and a second row of ball bearings positioned between the second and seventh flanges;

and wherein the second locating means comprises:

a third row of ball bearings positioned between the third and fifth flanges, and a fourth row of ball bearings positioned between the fourth and eighth flanges.

2. The sliding support of claim 1 wherein the connecting member comprises a fifth web which connects the fifth and seventh flanges together at their open ends.

3. The sliding support claim 2 wherein the angle between the connecting member and the first and second webs is in the range of 70 to 80 degrees.

4. The sliding support of claim 2 wherein the angle between the connecting member and the first and second webs is in the range of 60 to 85 degrees.

5. The sliding support of claim 2 wherein:

the first locating means comprises a first retainer for retaining the first and second rows of ball bearings in two parallel rows, one row on each side of each of the first slide member, between the first slide member and the intermediate member, and the second locating means comprises a second retainer for retaining the third and fourth rows of ball bearings in two parallel rows, one row on each side of the second slide member, between the second slide member and the intermediate member, to locate slidingly the intermediate member within the first and second slide members.

6. The sliding support of claim 2 wherein the first and second locating means each comprise a plastics strip arranged between the respective slide member and the intermediate member, to locate slidingly the intermediate member within the first and second slide members.

7. The sliding support claim 1 wherein the angle between the connecting member and the first and second webs is in the range of 70 to 80 degrees.

8. The sliding support of claim 7 wherein the first and second locating means each comprise a plastics strip arranged between the respective slide member and the intermediate member, to locate slidingly the intermediate member within the first and second slide members.

9. The sliding support of claim 1 wherein the angle between the connecting member and the first and second webs is in the range of 60 to 85 degrees.

10. The sliding support of claim 9 wherein the first and second locating means each comprise a plastics strip arranged between the respective slide member and the intermediate member, to locate slidingly the intermediate member within the first and second slide members.

11. The sliding support of claim 1 wherein:

the first locating means comprises a first retainer for retaining the first and second rows of ball bearings in two parallel rows, one row on each side of each of the first slide member, between the first slide member and the intermediate member, and the second locating means comprises a second retainer for retaining the third and fourth rows of ball bearings in two parallel rows, one row on each side of the second slide member, between the second slide member and the intermediate member, to locate slidingly the intermediate member within the first and second slide members.

12. The sliding support of claim 1 wherein the cross-sectional profile of each of the first to eighth flanges is shaped to provide half of a ball engaging channel such that the rows of ball bearings are retained between the respective first and second slide members and the intermediate member in a plurality of ball channels.

13. The sliding support of claim 1 wherein the first and second locating means each comprise a plastics strip arranged between the respective slide member and the intermediate member, to locate slidingly the intermediate member within the first and second slide members.

14. The sliding support of claim 1 wherein the angle between the connecting member and the first and second webs is in the range of 60 to 85 degrees.

15. The sliding support of claim 1 wherein the first and second locating means each comprise a plastics strip arranged between the respective slide member and the intermediate member, to locate slidingly the intermediate member within the first and second slide members.

16. A sliding support comprising:

a first elongate slide member having a channel shaped cross section and including first and second flanges and a first web disposed between the flanges, a second elongate slide member having a channel shaped cross section and including third and fourth flanges and a second web parallel to the first web disposed between the third and fourth flanges, the first and second flanges being offset relative to the third and fourth flanges in a direction parallel to the first and second webs, and an intermediate member positioned between the first and second slide members, the intermediate member comprising a first portion having a channel shaped cross section and including fifth and sixth flanges and a third web connected between the fifth and sixth flanges; and a second portion having a channel shaped cross section and including seventh and eighth flanges and a fourth web connected between the seventh and eighth flanges;

a connecting member connected between the fifth and seventh flanges and arranged at an angle to the first and second webs, wherein the angle between the connecting member and the first and second webs is in the range of 30 to 85 degrees, first locating means positioned between the first slide member and the intermediate member to locate and align the first slide member and the intermediate member for sliding without contact therebetween, second locating means positioned between the second slide member and the intermediate member to locate and align the second slide member and the intermediate member for sliding without contact therebetween; and the first locating means comprising a first multiplicity of ball bearings and a first retainer for retaining the first ball bearings in two parallel rows, one row on each side of each of the first slide member, between the first slide member and the intermediate member, and the second locating means comprising a second multiplicity of ball bearings and a second retainer for retaining the second ball bearings in two parallel rows, one row on each side of the second slide member, between the second slide member and the intermediate member to locate slidingly the intermediate member within the first and second slide members, wherein:

a first row of the first multiplicity of ball bearings is positioned between the first and sixth flanges, a second row of the first multiplicity of ball bearings is positioned between the second and seventh flange, a first row of the second multiplicity of ball bearings is positioned between the third and fifth flanges, and a second row of the second multiplicity of ball bearings is positioned between the fourth and eighth flanges.

17. The sliding support of claim 16 wherein:

the first locating means comprises a first retainer for retaining the first multiplicity of ball bearings in two parallel rows, one row on each side of each of the first slide member, between the first slide member and the intermediate member, and the second locating means comprises a second retainer for retaining the second multiplicity of ball bearings in two parallel rows, one row on each side of the second slide member, between the second slide member and the intermediate member, to locate slidingly the intermediate member within the first and second slide members.

* * * * *